10/22/85 OR 4,548,588

United States Patent [19]

Kosuge

[11] Patent Number: 4,548,588

[45] Date of Patent: Oct. 22, 1985

[54] SWIMMING AID

[75] Inventor: Masana Kosuge, Tokyo, Japan

[73] Assignee: Kosuage Planning Co. Ltd., Japan

[21] Appl. No.: 624,726

[22] Filed: Jun. 26, 1984

[30] Foreign Application Priority Data

Jun. 29, 1983 [JP] Japan ..... 58-99352[U]

[51] Int. Cl.[4] ..... A63B 31/02

[52] U.S. Cl. ..... 441/57; 441/55; 441/56

[58] Field of Search ..... 441/57, 56, 58, 55

[56] References Cited

U.S. PATENT DOCUMENTS

| | | | |
|---|---|---|---|
| 2,317,886 | 4/1943 | Coddlington | 441/57 |
| 3,174,167 | 3/1965 | Pauley | 441/57 |
| 3,231,910 | 2/1966 | Tegland | 441/57 |
| 3,257,673 | 6/1984 | Rademacher | 441/57 |
| 4,195,365 | 4/1980 | Eyman | 441/57 |

*Primary Examiner*—Trygve M. Blix
*Assistant Examiner*—C. T. Bartz
*Attorney, Agent, or Firm*—Steinberg & Raskin

[57] ABSTRACT

A swimming aid includes a plurality of tubular members, each tubular member adapted to fit on a corresponding finger of a human hand and which is open at both ends thereof, and web-like members extending between adjacent ones of the tubular members.

3 Claims, 4 Drawing Figures

SWIMMING AID

BACKGROUND OF THE INVENTION

The present invention relates generally to swimming aids for use in swimming and underwater operations and, more particularly, to swimming aids adapted to be associated with the hands of a swimmer.

Swimming aids adapted to be associated with the hands of a swimmer are known. Examples of conventional swimming aids of this type include the swimming gloves disclosed in Japanese Utility Model Publication Nos. 4,150/1953 and 29,439/1977. Conventional swimming gloves of this type are constructed so that all of the fingers are covered with a glove-like product up to the finger tips, the glove-like product having a web-like membrane stretched between the adjacent fingers thereof.

Conventional swimming gloves of this type have the disadvantage that a swimmer wearing the same cannot perform any useful work with his hands so that the use of such swimming gloves is limited only to swimming exercises. Further, conventional swimming gloves are disadvantageously complicated in construction and exceedingly high in production cost.

SUMMARY OF THE INVENTION

Accordingly, it is an object of the present invention to provide a new and improved swimming aid.

Another object of the present invention is to provide a new and improved swimming aid which not only has as its primary function to aid a person in swimming but which, additionally, is useful in underwater operations which require delicate manual operations in various water and underwater sports.

Still another object of the present invention is to provide a new and improved swimming aid which is simple in construction and economical in production.

Briefly, in accordance with the present invention, these and other objects are attained by providing a swimming aid including a plurality of tubular members, each of which is adapted to be fitted on a corresponding finger and has both ends thereof opened, and web-like members extending between adjacent ones of the tubular members.

DETAILED DESCRIPTION OF THE DRAWINGS

A more complete appreciation of the present invention and many of the attendant advantages thereof will be readily understood by reference to the following detailed description when considered in connection with the accompanying drawings, in which.

DESCRIPTION OF THE PREFERRED EMBODIMENTS

Figure 1:
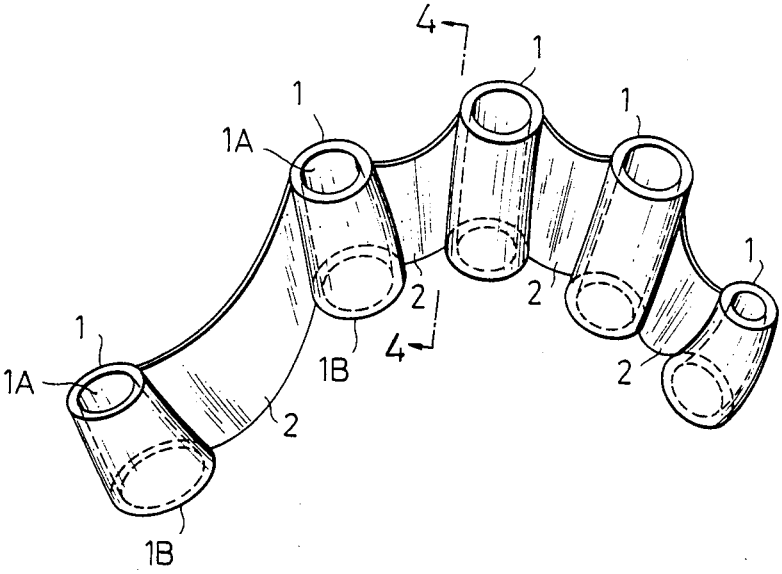
FIG. 1 is a perspective view of one embodiment of a swimming aid in accordance with the present invention.

Referring now to the drawings wherein like reference characters designate identical or corresponding parts throughout the several views, and more particularly to FIG. 1, a swimming aid in accordance with the invention comprises a plurality of tubular members 1 (five shown) each of which has a length which is substantially equal to the distance between a first-joint portion and a proximal portion of a corresponding finger on which it is adapted to fit. Each tubular member 1 has a pair of opposed ends 1A and 1B which are opened. Web-like members 2 extend between adjacent pairs of tubular members 1.

In operation, a swimming aid of the type illustrated in FIG. 1 is associated with a respective hand of a swimmer by fitting each tubular member 1 onto a respective finger so that the tip of the finger protrudes through and beyond the open end 1A thereof thereby allowing the swimmer a high degree of manual dexterity even while the swimming aid is worn. Of course, the web-like members 2 provide a paddling effect enhancing the ability of the swimmer to move through the water.

Figure 2:
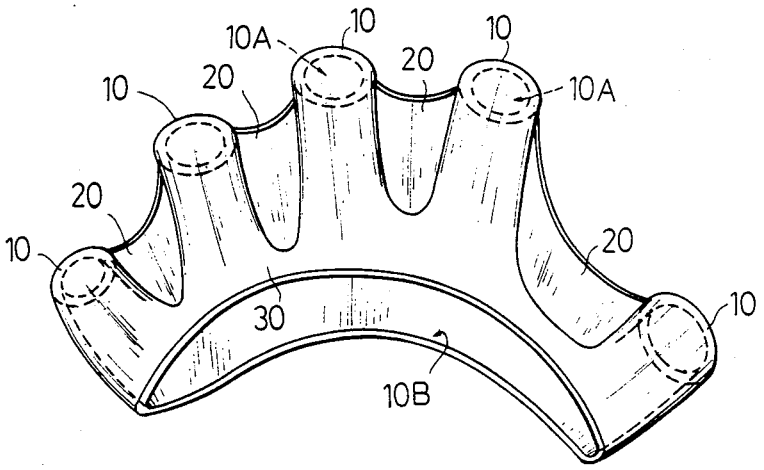
FIG. 2 is a perspective view of another embodiment of a swimming aid in accordance with the present invention and in which the tubular members are connected to each other at the proximal portions thereof.

Referring to FIG. 2, a second embodiment of the invention is illustrated in which a plurality of tubular members 10 are connected to each other at a common proximal portion 30 and wherein web-like members 20 respectively extend between adjacent pairs of the tubular members 10. Each tubular member 10 has an end 10A which is open independent of the corresponding ends of the other tubular members and a second end 10B which is open in common with the corresponding ends of the other tubular members. This embodiment of the invention provides increased structural strength for the swimming aid.

Figure 3:
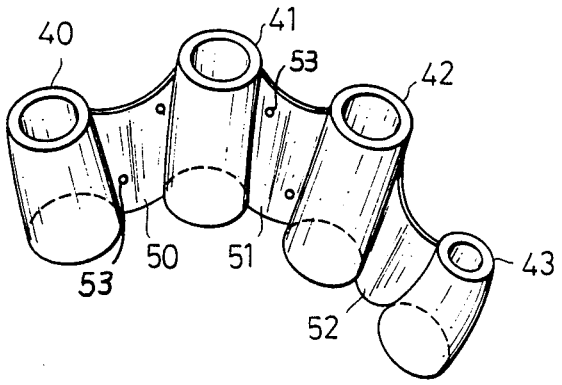
FIG. 3 is a perspective view of a third embodiment of a swimming aid in accordance with the present invention.

The third embodiment of the present invention is illustrated in FIG. 3. Referring to FIG. 3, the swimming aid comprises four tubular members 40, 41, 42 and 43 and web-like members 50, 51 and 52 which extend respectively between pairs of adjacent ones of the tubular members 40–43. The tubular members 40–43 are adapted to respectively fit over the fingers of the hand except for the thumb. The remainder of the construction of the embodiment of the invention illustrated in FIG. 3 is substantially similar to that illustrated in FIG. 1.

Figure 4:
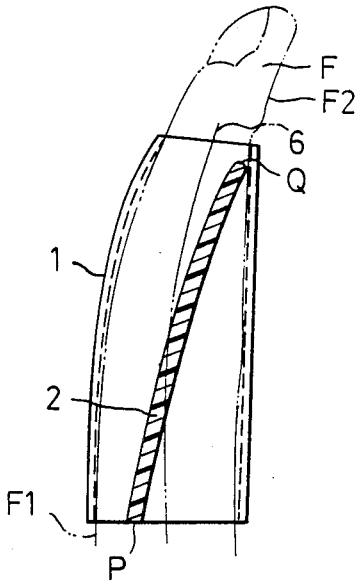
FIG. 4 is a section view taken along line 4—4 of FIG. 1.

Referring to FIG. 4 which constitutes a section view taken along line 4—4 of FIG. 1, a preferred relationship of the connection between the web-like members 2 and the tubular members 1 along a joining line is illustrated.

In particular, referring to FIG. 4, the web-like members 2 are situated such that when each tubular member 1 is fitted over a corresponding finger F, the associated web-like member 2 is situated eccentrically with respect to the longitudinal central axis 6 of the tubular member 1. More specifically, the end portion P of the joining line of the web-like member 2 to the tubular member 1 is situated closer to the back side F1 of the proximal portion of the finger than is the axis 6. On the other hand, the end portion Q of the joining line of the web-like member 2 to the tubular member 1 is situated closer to the front side F2 of the tip portion of the finger than is the central axis 6. This arrangement of the web-like members 2 with respect to the tubular members 1 enhances the paddling effect thereof.

The tubular and web-like members in each of the embodiments described above can be formed of any suitable material such, for example, as a synthetic resin, synthetic rubber, synthetic fiber, leather, synthetic leather or a laminate of such materials such, for example, as a rubber coated fabric, nylon jersey, a chemical fiber knitted cloth, or the like. The tubular members 1, 10, 40–43, may be formed of a mesh-like material as determined by the particular material employed.

Further, the number of the tubular members need not necessarily be five. Thus, a number of tubular members less than five with the web-like members extending therebetween will still provide a paddling effect to a certain degree. In addition, the web-like members may be provided with small openings, such as openings 53 as seen in FIG. 3, which can to some degree provide an adjustment for water resistance.

It should also be noted that although in the embodiments described above each tubular member has a length which is substantially equal to the distance between the first-joint portion and the proximal portion of the corresponding finger on which it is adapted to be fit, and is formed with a cylindrical shape, the length and shape of the tubular members are not so limited but can be varied from that shown in the illustrated embodiments.

The embodiments of the swimming aid in accordance with the invention as described above are constructed only of the constituent parts which provide the minimum requirements of the invention. Therefore, the swimming aid can be provided at reduced production costs. Moreover, the swimming aid in accordance with the invention not only provides the effect of the web-like members, which is a primary function of the swimming aid, but also enables a person to utilize the swimming aid under conditions which more closely resemble those of a bare-handed swimmer. In this manner, a high degree of manual dexterity or workability and movability is provided when the swimming aid of the invention is used in various underwater operations which require delicate manual work, such as skin diving and underwater photography, and various water and underwater sports, such as surfing and shooting a spear gun.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A swimming aid, comprising a plurality of tubular members, each tubular member adapted to fit on a corresponding finger of a human hand and having a pair of ends, each of which is open, each of said tubular members having a central longitudinal axis, and web-like members extending between adjacent ones of said tubular members, each of said web-like members having respective sides which mate with respective adjacent tubular members along respective joining lines, with the separate tubular members interconnected only by said web-like members, wherein each of said web-like members is situated eccentrically with respect to the longitudinal axis of said tubular members between which it extends, with one end portion of each respective joining line shaped to be situated closer to a back side of a proximal portion of the finger than the longitudinal axis of the joined tubular member, and the opposite end portion of the joining line shaped to be situated closer to a front side of a tip portion of the finger than the longitudinal axis of the joined tubular member, when the tubular member is fitted on the corresponding finger.

2. A swimming aid in accordance with claim 1 wherein the length of each of said tubular members is substantially equal to the distance between a first-joint portion and the proximal portion of the corresponding finger on which it is adapted to fit.

3. A swimming aid in accordance with claim 1 wherein openings are formed in at least one of said web-like members.

* * * * *